US011627767B2

(12) United States Patent
Mithani et al.

(10) Patent No.: US 11,627,767 B2
(45) Date of Patent: Apr. 18, 2023

(54) TOTAL PROTECTION GARMENT FOLD

(71) Applicant: O&M Halyard, Inc., Mechanicsville, VA (US)

(72) Inventors: Namita A. Mithani, Alpharetta, GA (US); Brian E. Lin, Cumming, GA (US); Samuel G. Israel, Alpharetta, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 98 days.

(21) Appl. No.: 17/111,612

(22) Filed: Dec. 4, 2020

(65) Prior Publication Data

US 2021/0169158 A1 Jun. 10, 2021

Related U.S. Application Data

(60) Provisional application No. 62/943,315, filed on Dec. 4, 2019.

(51) Int. Cl.
*A41D 13/12* (2006.01)
*A41D 13/11* (2006.01)

(52) U.S. Cl.
CPC ..... *A41D 13/1218* (2013.01); *A41D 13/1153* (2013.01); *A41D 2400/42* (2013.01); *A41D 2400/44* (2013.01); *A41D 2400/52* (2013.01); *A41D 2400/70* (2013.01)

(58) Field of Classification Search
CPC ..... A41D 13/1218; A41D 13/1153; A41D 2400/44
See application file for complete search history.

(56) References Cited

U.S. PATENT DOCUMENTS

| | | | | |
|---|---|---|---|---|
| 3,721,999 | A | 3/1973 | Goya et al. | |
| 5,097,534 | A * | 3/1992 | Viemeister | A41D 27/10 2/84 |
| 5,862,525 | A * | 1/1999 | Tankersley | D06F 89/02 2/243.1 |
| 6,481,019 | B2 | 11/2002 | Diaz et al. | |
| 6,622,311 | B2 | 9/2003 | Diaz et al. | |
| 6,973,677 | B2 | 12/2005 | Diaz et al. | |
| 7,752,682 | B2 | 7/2010 | VanDerWoude et al. | |

(Continued)

FOREIGN PATENT DOCUMENTS

| | | |
|---|---|---|
| EP | 0 507 606 A1 | 10/1992 |
| WO | WO 89/08994 A1 | 10/1989 |

OTHER PUBLICATIONS

International Search Report and Written Opinion for PCT/US2020/063212, dated Mar. 25, 2021, 13 pages.

*Primary Examiner* — Katherine M Moran
(74) *Attorney, Agent, or Firm* — Dority & Manning, P.A.

(57) ABSTRACT

A folded article formed from a protective garment, and a method of folding a protective garment to prepare the garment for donning, expose sleeve openings of the garment for ease of donning. The protective garment is folded into a folded article that is configured to be grasped by an inner surface of the garment and prevent touching the outer surface of the garment during donning. Thus, the sterility of the protective garment can be maintained during donning. The protective garment may further include a hood and visor, and the folded article formed from the protective garment may have the same size and shape as the visor.

19 Claims, 8 Drawing Sheets

(56) References Cited

U.S. PATENT DOCUMENTS

| | | | | |
|---|---|---|---|---|
| 8,234,722 | B2 | 8/2012 | VanDerWoude et al. | |
| 8,407,818 | B2 | 4/2013 | VanDerWoude et al. | |
| 8,819,869 | B2 | 9/2014 | VanDerWoude et al. | |
| 9,265,292 | B2 | 2/2016 | Smith et al. | |
| 2009/0019616 | A1 | 1/2009 | Smith et al. | |
| 2015/0135398 | A1* | 5/2015 | Czajka | A41D 13/12 2/114 |
| 2016/0120240 | A1* | 5/2016 | Vanneste | A41D 13/1184 2/457 |

* cited by examiner

TOTAL PROTECTION GARMENT FOLD

RELATED APPLICATION

This application claims priority to U.S. Provisional Application No. 62/943,315 entitled "Total Protection Gown Fold," filed on Dec. 4, 2019, the contents of which are incorporated herein by reference.

FIELD OF THE INVENTION

The subject matter of the present invention relates generally to a method of folding a personal protection garment for sterile donning.

BACKGROUND

Surgeons and other healthcare providers often wear a combination of a surgical suit or gown, a hood, and an air cooling or ventilation system during operating procedures, particularly orthopedic total joint replacement surgeries such as arthroplasties and revisions of the knee, hip, and shoulder, in order to ensure sterile conditions in the operating room, protect the wearer, and create a comfortable environment for the wearer in terms of ventilation and cooling. Such a total protection suit can include a surgical gown, a hood with a viewing visor, and optionally a ventilation system that can include a fan and battery. It is critical to present the total protection gown and hood to the user in a manner that allows aseptic donning of the gown during use. If the gown is not folded such that it allows the user to keep their hands sterile during donning, or if the sleeves are folded in such a manner that the sleeves drop below the waist of the user while donning, the gown is not considered acceptably sterile for surgery. Additionally, if the entire gown drops or falls on the floor during the process of donning, the gown is not considered acceptably sterile for surgery. If any of these scenarios occur during donning, the user must discard the gown and start the donning process all over again with a new, sterile total protection gown. This causes delays in the user's preparation for surgery.

In addition, the total protection gown may include a hood having an integrated protective visor. The protective visor may include plastic clips to connect the visor to a helmet worn inside the gown or hood. The total protection gown and hood are sterile, whereas the helmet is non-sterile. As a result, it is critical for the user to make the connection between the visor and the helmet without compromising the sterility of the total protection gown and hood.

Moreover, if the total protection gown is folded or provided to the user in such a manner as to make it difficult for the user to locate the sleeve opening during donning, the process of donning the total protection gown will be more challenging, which may lead to increased frequency of the above-described scenarios in which the sterility of the total protection gown is compromised during donning.

Consequently, there is a need for a method of folding a garment, e.g., a protective garment having a gown and hood, without compromising the sterility of the garment.

SUMMARY

Objects and advantages of the invention will be set forth in part in the following description, or may be obvious from the description, or may be learned through practice of the invention.

The present invention is directed to a folded article comprising a garment having a body and two sleeves. The garment includes a body and two sleeves, and an inner surface and an outer surface. Each sleeve is connected to the body at a sleeve opening on the inner surface of the garment. The garment further includes a hood having a visor. The garment is folded in a configuration such that the sleeve openings are exposed for ease of donning the garment and none of the outer surface of the garment is exposed.

In one particular embodiment, the visor can have a length and a width, and the folded article can include a shape and size that matches the length and width of the visor. Moreover, each of the sleeve openings can extend parallel to an axis extending along the width of the visor.

In another embodiment, each sleeve can include an upper sleeve portion and a lower sleeve portion, wherein the upper sleeve portion of each sleeve can be folded over the visor. Moreover, the lower sleeve portion of each sleeve can be folded within the upper sleeve portion of each respective sleeve.

The present invention is further directed to a method of folding a garment. The method includes the steps of:

providing a garment comprising a body, a first sleeve and a second sleeve, wherein the garment includes an inner surface and an outer surface, wherein the first sleeve is connected to the body at a first sleeve opening on the inner surface of the garment and the second sleeve is connected to the body at a second sleeve opening on the inner surface of the garment;

turning the garment inside-out such that the inner surface of the garment is exposed;

tucking a lower portion of the first sleeve within an upper portion of the first sleeve and tucking a lower portion of the second sleeve within an upper portion of the second sleeve such that the lower portion of the first sleeve and the lower portion of the second sleeve are each in contact with the outer surface of the garment;

folding a distal end of the body of the garment along a first body fold line toward a proximal end of the body of the garment;

folding the body of the garment one or more times to form at least one S-shaped fold; and folding the upper portion of the first sleeve over the body of the garment along a first upper sleeve fold line to expose the first sleeve opening and the upper portion of the second sleeve over the body of the garment along a second upper sleeve fold line to expose the second sleeve opening.

In one particular embodiment, the garment further comprises a hood having a visor, the hood extending from the proximal end of the body of the garment, further wherein the method can include a step of folding the hood along a hood fold line such that the hood and visor are positioned on top of the body of the garment. Moreover, the garment can be folded such that the visor is exposed atop the body of the garment. Further, the upper portions of the first sleeve can be folded along the first upper sleeve fold line such that the upper portion of the first sleeve can be positioned on top of the visor.

In another embodiment, the first upper sleeve fold line can coincide with the first sleeve opening and the second upper sleeve fold line can coincide with the second sleeve opening.

In an additional embodiment, the lower portion of each sleeve can include a cuff, and the method can further include a step of folding the cuff of the first sleeve toward the upper portion of the first sleeve along a first lower sleeve fold line and folding the cuff of the second sleeve toward the upper portion of the second sleeve along a second lower sleeve fold line.

In yet another embodiment, the lower portion of the first sleeve and the lower portion of the second sleeve can overlap each other.

In a further embodiment, the body of the garment can include a front panel and first and second rear panels, wherein the first and second rear panels are separated when the step of tucking the lower portions of each sleeve is performed.

The present invention is further directed to a method of preparing a protective garment for donning. The method includes steps of:

providing a garment having a body, a first sleeve and a second sleeve, wherein the garment includes an inner surface and an outer surface, wherein the first sleeve is connected to the body at a first sleeve opening on the inner surface of the garment and the second sleeve is connected to the body at a second sleeve opening on the inner surface of the garment; and folding the garment such that the garment is configured to be grasped by a wearer by the inner surface of the garment without touching the outer surface of the garment, wherein the garment is folded such that the wearer is configured to insert their arms into the first sleeve opening and the second sleeve opening of the inner surface of the garment prior to accessing the body of the garment.

In one particular embodiment, the step of folding the garment can include tucking a lower portion of each sleeve within an upper portion of each sleeve such that the lower portion of the first sleeve and the lower portion of the second sleeve can be in contact with the outer surface of the garment. Moreover, the lower portion of the first sleeve and the lower portion of the second sleeve can overlap each other.

In another embodiment, the garment can further include a hood having a visor and clips configured to attach the visor to a piece of headwear, and the step of folding the garment can include folding the garment such that the visor clips are accessible to the wearer without touching the outer surface of the garment after the wearer inserts their hands into the sleeve openings. Moreover, an upper portion of the first sleeve can be folded along a first upper sleeve fold line and an upper portion of the second sleeve can be folded along a second upper sleeve fold line such that the upper portion of the first sleeve and the upper portion of the second sleeve can be positioned on top of the visor. Further, the first upper sleeve fold line can coincide with the first sleeve opening and the second upper sleeve fold line can coincide with the second sleeve opening These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1A:
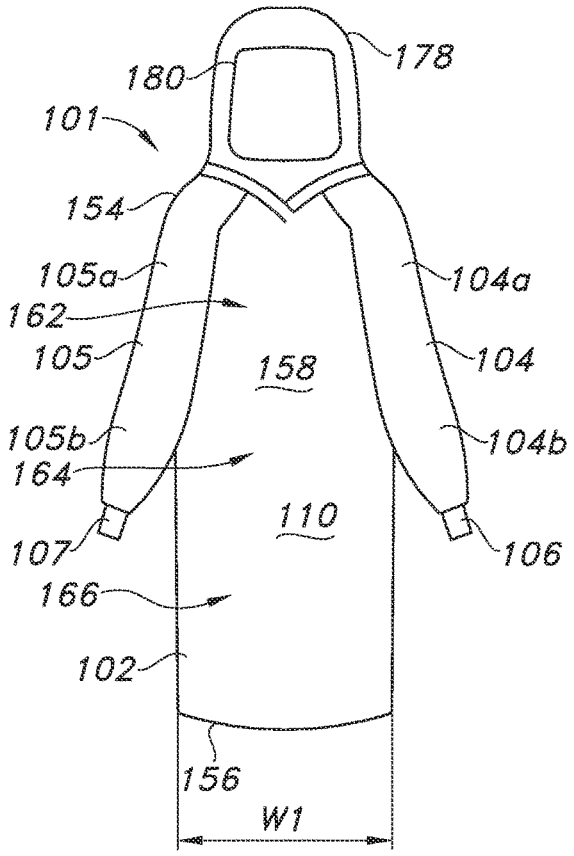
FIG. 1A illustrates a front view of a total protection gown according to one particular embodiment of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally speaking, the present invention is directed to a method for folding a garment to maintain the sterility of the garment during the donning process. The method includes steps of: providing a garment comprising a body and two sleeves, wherein the garment includes an inner surface and an outer surface, wherein each sleeve is connected to the body at a sleeve opening on the inner surface of the garment; turning the garment inside-out such that the inner surface of the garment is exposed; tucking a lower portion of each sleeve within an upper portion of each sleeve such that the lower portion of each sleeve is in contact with the outer surface of the garment; folding a distal end of the body of the garment along a first body fold line toward a proximal end of the body of the garment; folding the body of the garment one or more times to form at least one S-shaped fold; and folding the upper portions of the sleeves over the body of the garment along respective sleeve fold lines to expose the sleeve openings of each sleeve. The present invention is further directed to a method of preparing a protective garment for donning, and a folded article. The present inventors have found that the methods of folding or preparing a garment and the folded article of the present invention enable aseptic donning of the garment, which is critical for use during a medical procedure requiring that the garment maintains sterility. Moreover, the present inventors have found that the methods of folding or preparing a garment and the folded article of the present invention prevent the entire garment fabric from falling onto the floor (i.e., a non-sterile surface) during the process of donning.

The specific features of the method of the present invention may be better understood with reference to FIGS. 1-13.

Figure 1B:
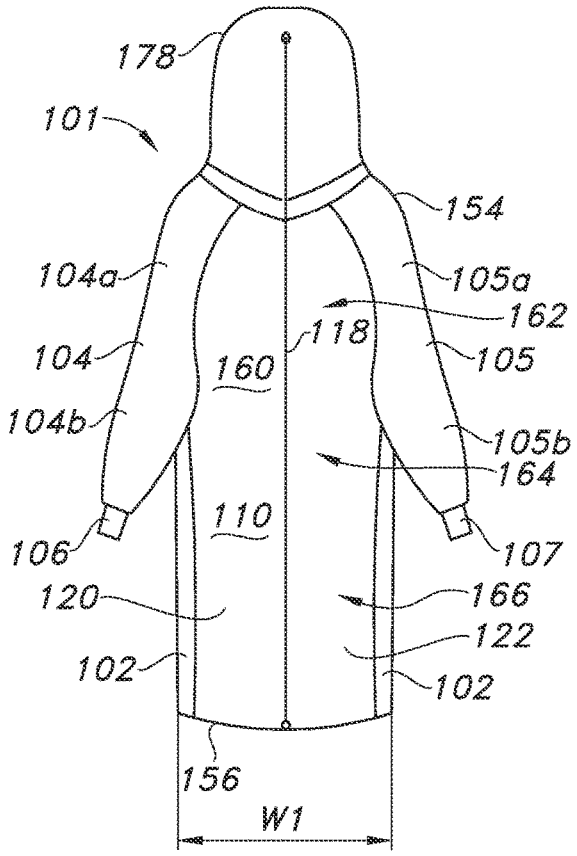
FIG. 1B illustrates a rear view of the gown of FIG. 1A.

Referring now to FIGS. 1A-B, an exemplary total protection gown 101 is shown. The gown 101 includes a front 158 and a rear 160 that can be worn by medical personnel during a surgical procedure, such as an orthopedic surgical procedure or any other procedure where protection from bodily fluids, bone fragments, etc. is desired. The front 158 of the gown 101 includes a front panel 102 defined between a proximal end 154 and a distal end 156 of the gown 101. As shown, the proximal end 154 of the gown 101 may include a hood 178 having a visor 180, where the hood 178 may be integral with the gown 101 as shown in FIGS. 1A-B. The gown 101 further includes an upper portion 162 adjacent the proximal end 154, a lower portion 166 adjacent to the distal end 158, and a middle portion 164 in between the upper portion 162 and the lower portion 166. The gown 101 also includes a first sleeve 104 and a second sleeve 105. Each of the sleeves 104, 105 includes an upper sleeve portion 104*a*, 105*a*; a lower sleeve portion 104*b*, 105*b*; and a cuff 106, 107 as shown in FIGS. 1A-B. The rear of the gown 101 may include a first rear panel 120 and a second rear panel 122. The first rear panel 120 and the second rear panel 122 may be releasably joined by a rear fastening means 118 which can be used to secure the gown 101 once it is worn by the wearer. Depending on whether the hood 178 is integral with the gown 101 or separate from the gown 101, the fastening means 118 can extend into the area of the hood (see FIG. 1B). The rear fastening means 118 can be a zipper, one or more ties (e.g., ties 210 shown in FIGS. 4A-B), or any other suitable fastening means for securing the gown 101 to the wearer. The gown 101 further includes an outer surface 110 and an inner surface 112. The inner surface 112 is configured to be in contact with the wearer of the gown 101, and the outer surface 110 is configured to be facing away from the wearer of the gown 101. For instance, the outer surface 110 can form a sterile barrier for use in a procedure such as a surgical procedure.

Figure 11:
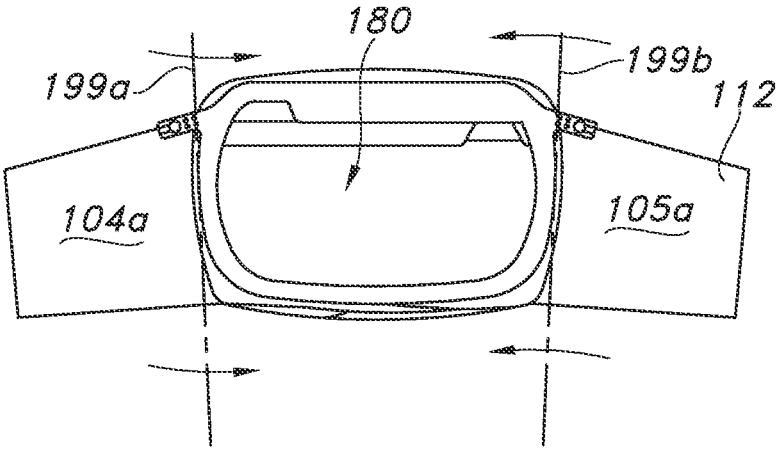
FIG. 11 illustrates the gown of FIG. 1A after performing step 10 and during performance of step 11 of the disclosed method of folding the gown.
Figure 12:
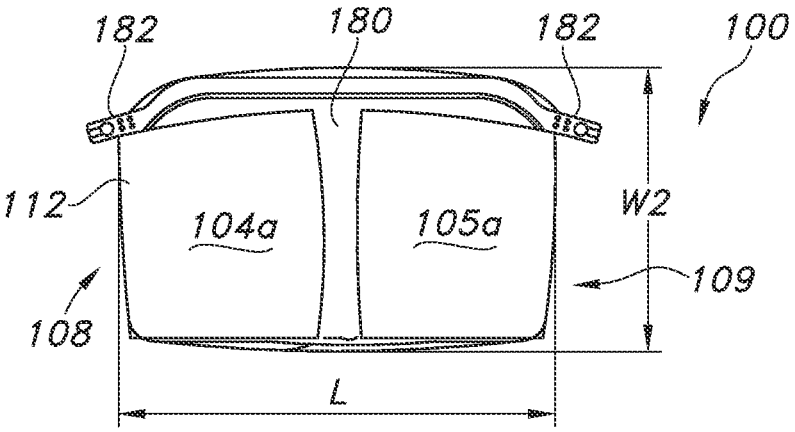
FIG. 12 illustrates a top view of the folded article 100 of the present invention after completion of step 11 of the disclosed method of folding the gown.
Figure 13:
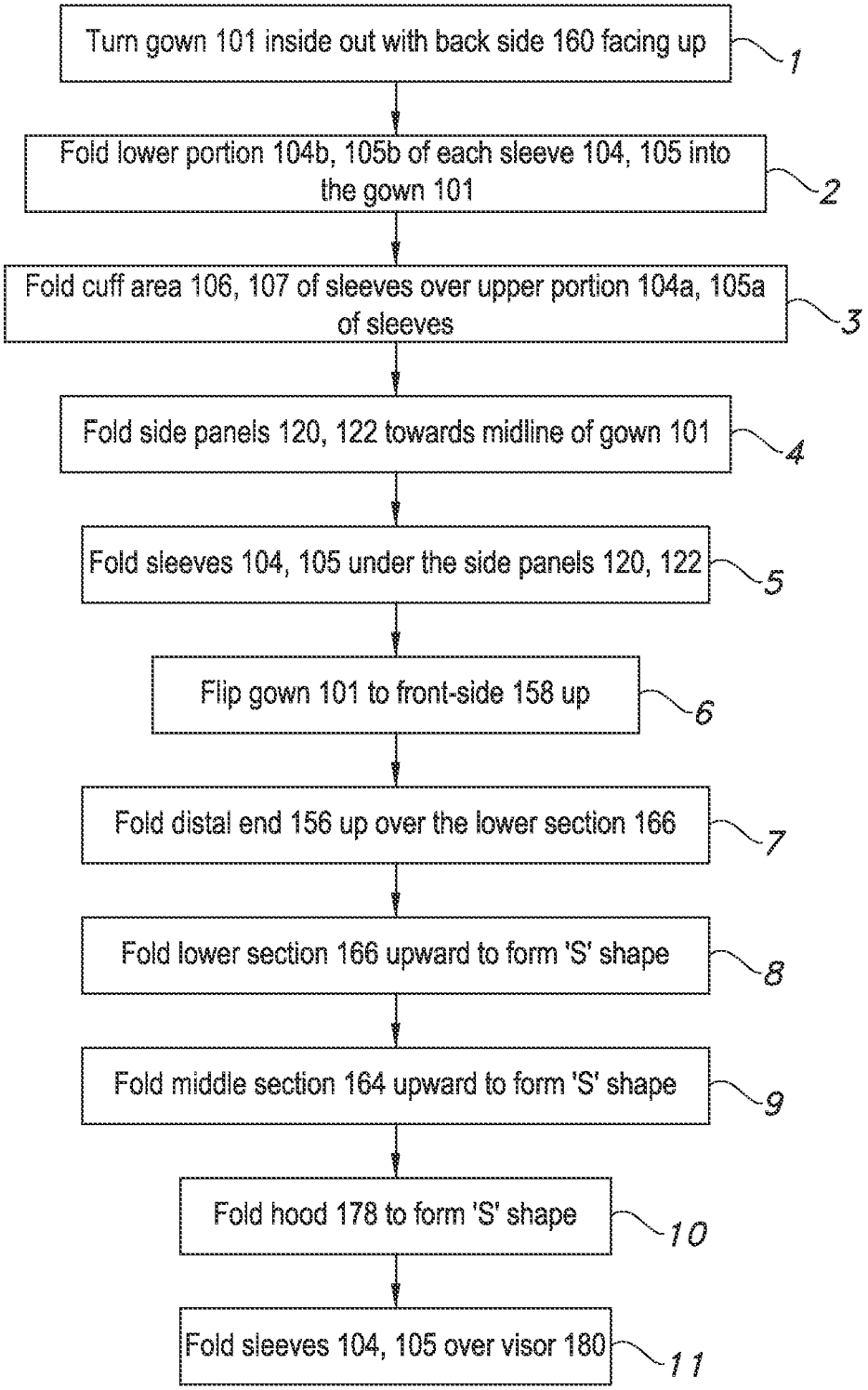
FIG. 13 shows a flow chart of the method steps of folding the gown according to one embodiment of the present invention.

FIG. 13 outlines the method steps of folding the gown 101 to form a final folded article 100 as shown in FIG. 12. The various steps of folding the gown 101 are illustrated in FIGS. 2-11.

Figure 2:
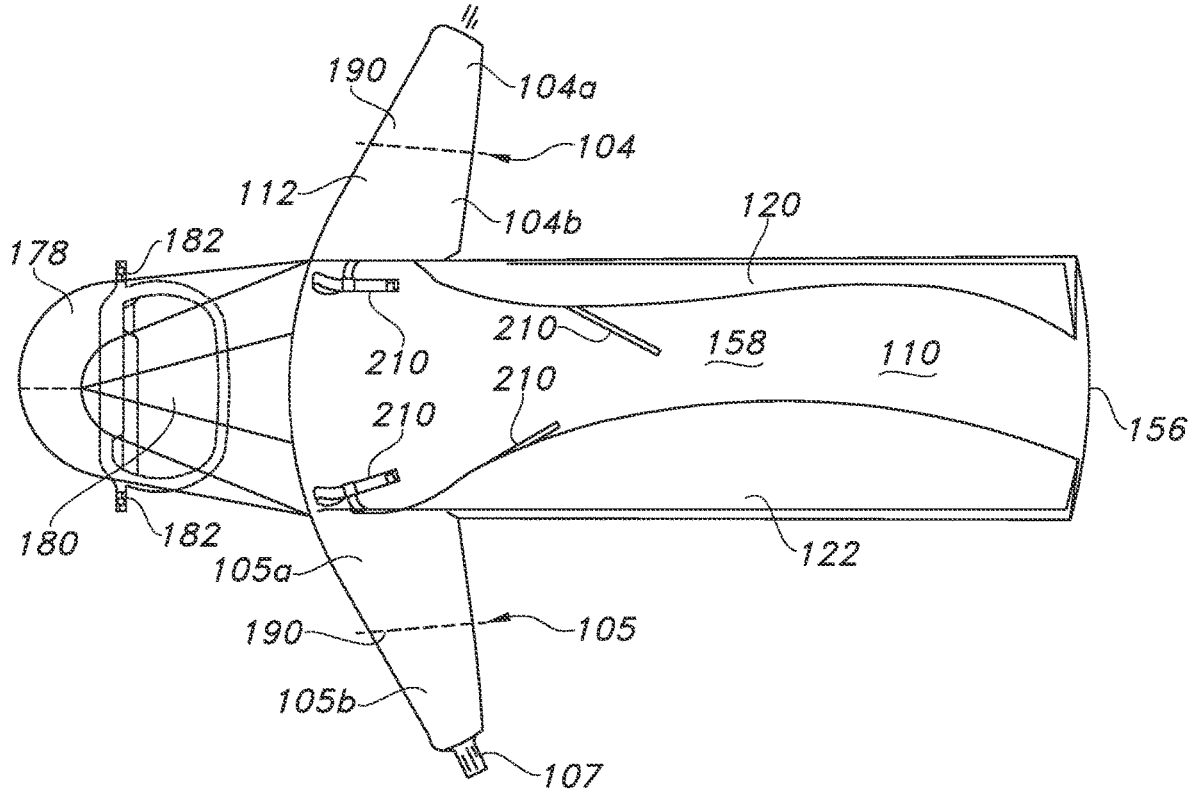
FIG. 2 illustrates the gown of FIG. 1A after performing step 1 of the disclosed method of folding the gown.

In step 1 of the method of folding the total protection gown 101, the entire gown 101 is turned inside out, such that the inner surface 112 is exposed, as shown in FIG. 2. The first rear panel 120 and second rear panel 122 may be pulled to the sides to expose the front panel 158. Additionally, as shown in FIG. 2, the material of the hood 178 may be folded over the surface of the visor 180 such that the clips 182 of the visor 180 stick outward.

Figure 3:
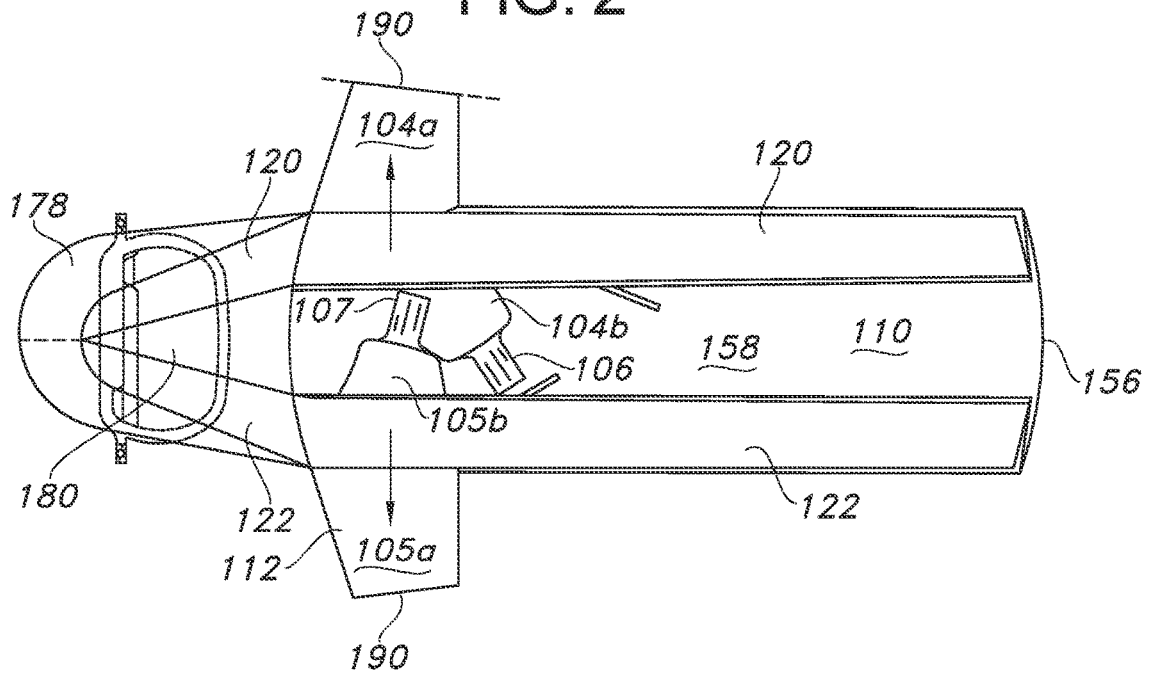
FIG. 3 illustrates the gown of FIG. 1A after performing step 2 of the disclosed method of folding the gown.

In step 2, as shown in FIG. 3, the lower portion 104*b* of the first sleeve 104 is tucked inside the upper portion 104*a* of the first sleeve 104, with the sleeve 104 being folded along a sleeve fold line 190. Additionally, the lower portion 105*b* of the second sleeve 105 is tucked inside the upper portion 105*a* of the second sleeve 105, with the second sleeve 105 being folded along a sleeve fold line 190. In this configuration, the cuffs 106, 107 of each sleeve 104, 105 are visible between the rear panels 120, 122 and lay on the front 158 of the gown 101.

Figure 4A:
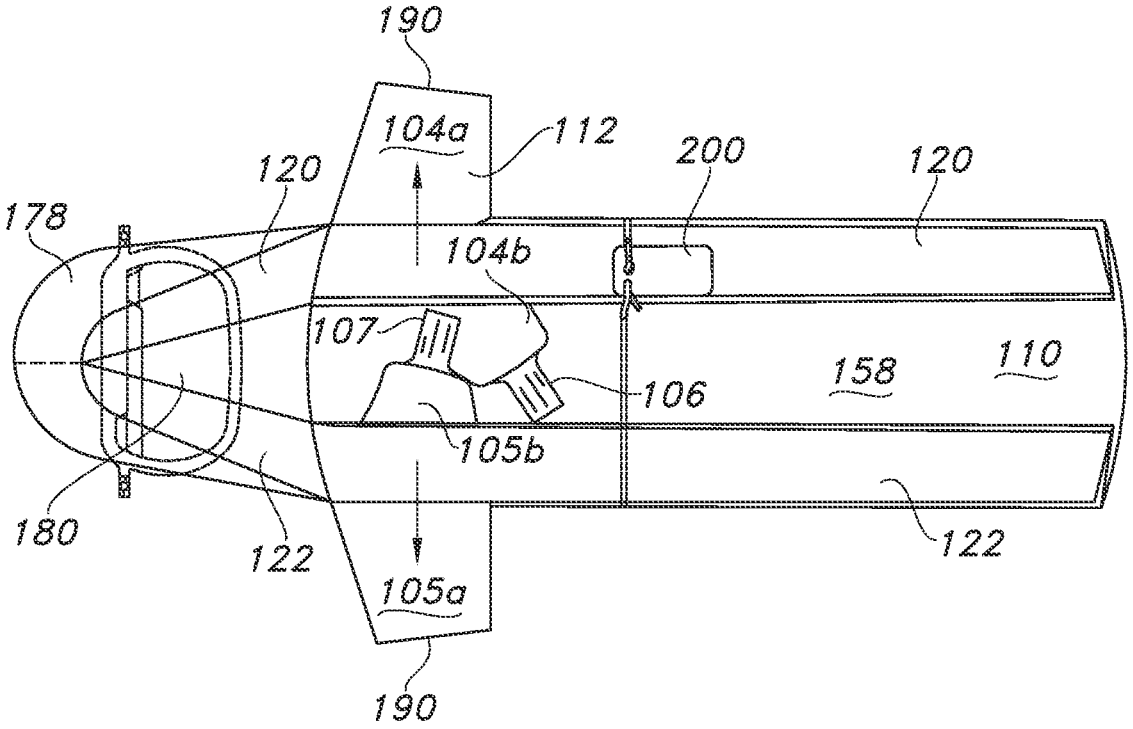
FIG. 4A illustrates the gown of FIG. 1A after attaching a tie card to the gown.
Figure 4B:
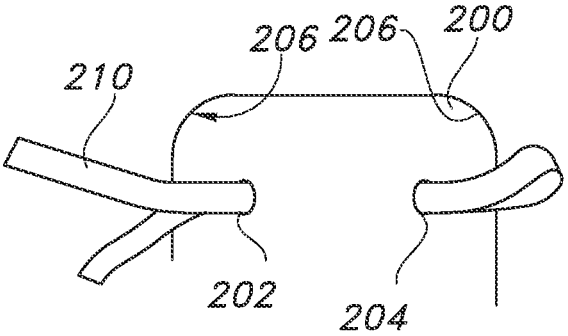
FIG. 4B illustrates a zoomed in top view of the attachment of the tie strings to the tie card of FIG. 4A.

Next, as shown in FIGS. 4A-B, a tie card 200 may optionally be attached to the side ties 210. For instance, the tie card 200 may include openings 202 and 204 through which the side ties 210 can be inserted and secured. The tie card 200 can be formed from paperboard or any other suitable material. The tie card 200 can be in the form of a rectangular shape, as shown in FIG. 4A, or any other suitable shape that can serve as a guide for folding the gown 101. The tie card 200 can have rounded corners 206 so as to eliminate any pointed corners that could damage the material of the gown 101.

Figure 5:
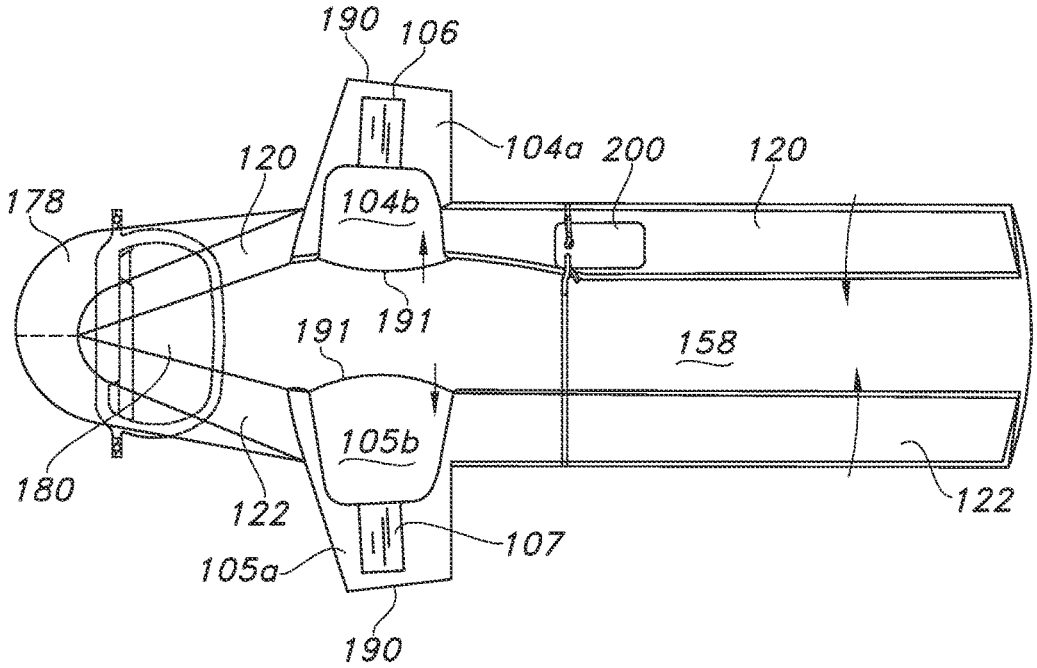
FIG. 5 illustrates the gown of FIG. 1A after performing step 3 of the disclosed method of folding the gown.

In step 3, as shown in FIG. 5, the lower portion 104*b* of the first sleeve 104 is folded back toward the sleeve fold line 190 of the first sleeve 104 along a lower sleeve fold line 191, such that the lower sleeve portion 104*b* and the cuff 106 rests on the upper sleeve portion 104*a*. Similarly, the lower portion 105*b* of the second sleeve 105 is folded back toward the sleeve fold line 190 of the second sleeve 105, such that the lower sleeve portion 105*b* and the cuff 107 rests on the upper sleeve portion 105*a*.

Figure 6:
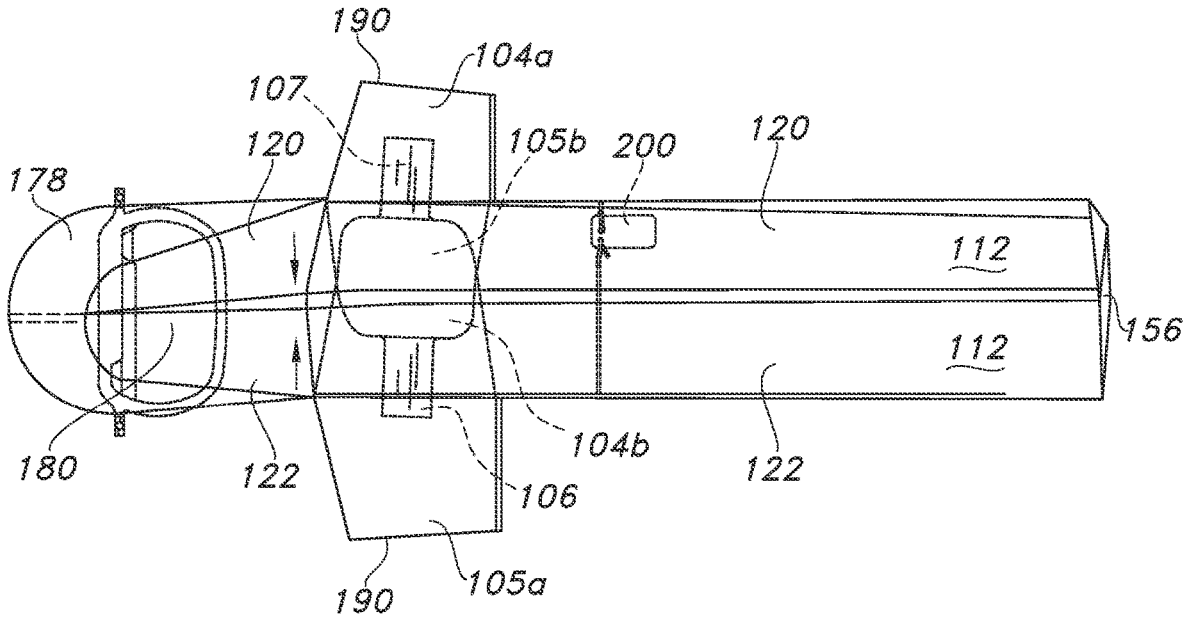
FIG. 6 illustrates the gown of FIG. 1A after performing steps 4 and 5 of the disclosed method of folding the gown.

In step 4, illustrated in FIG. 6, the first rear panel 120 and the second rear panel 122 are folded back toward the midline of the gown 101 such that the inner surface 112 of the first rear portion 120 and the second rear portion 122 is exposed. Additionally, in step 5, the lower sleeve portions 104*b* and 105*b* including the cuffs 106 and 107 are folded back toward the midline of the gown 101, essentially undoing the fold along the lower sleeve fold lines 191. The cuff 107 of the second sleeve 105 may be placed overlapping, e.g., on top of, the lower portion 104*b* of the first sleeve 104. Alternatively, the cuff 106 of the first sleeve 104 may be placed overlapping, e.g., on top of, the lower portion 105*b* of the second sleeve 105. In such a configuration in which the cuffs 106, 107 of the sleeves 104, 105 are crossed, as shown in FIG. 6, a wearer may be able to don the gown 101 more easily by naturally extending their arms across the midline while navigating the arms through the sleeves 104, 105.

The lower sleeve portions 104*b* and 105*b* including the cuffs 106 and 107 can be tucked beneath the first rear portion 120 and the second rear portion 122, respectively, as shown in phantom in FIG. 6. In this configuration, the lower portions 104*b* and cuffs 106 of the sleeves 104 are completely folded within and enclosed within the gown 101.

After performing step 4, as shown in FIG. 6, only the inner surface 112 of the gown 101 is exposed and the entire outer surface 110 of the gown 101 is enclosed. In such a configuration, when the gown 101 is sterilized, the sterility of the outer surface 110 can be preserved by preventing unwanted exposure of the outer surface 110.

Figure 7:
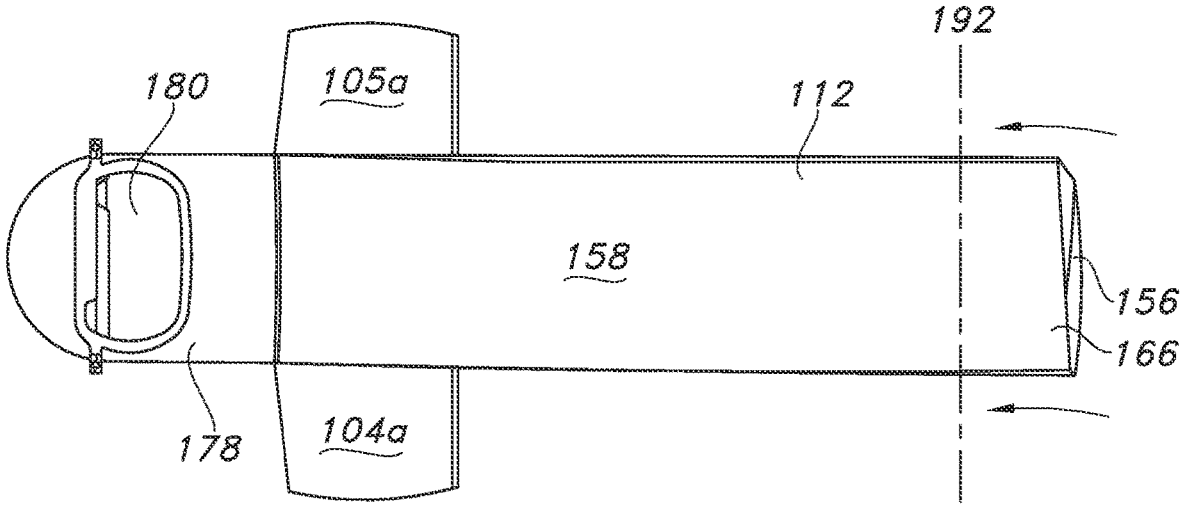
FIG. 7 illustrates the gown of FIG. 1A after performing steps 6 and 7 of the disclosed method of folding the gown.

Next, in step 6, the gown 101 is flipped so that the front side 158 of the gown 101 and the visor 180 face up, and the first rear panel 120 and second rear panel 122 are face down, as shown in FIG. 7.

Then, in step 7, the distal end 156 and lower portion 166 of the gown 101 are folded upward in the direction of the visor 180 and proximal end 154 along the fold line 192.

Figure 8:
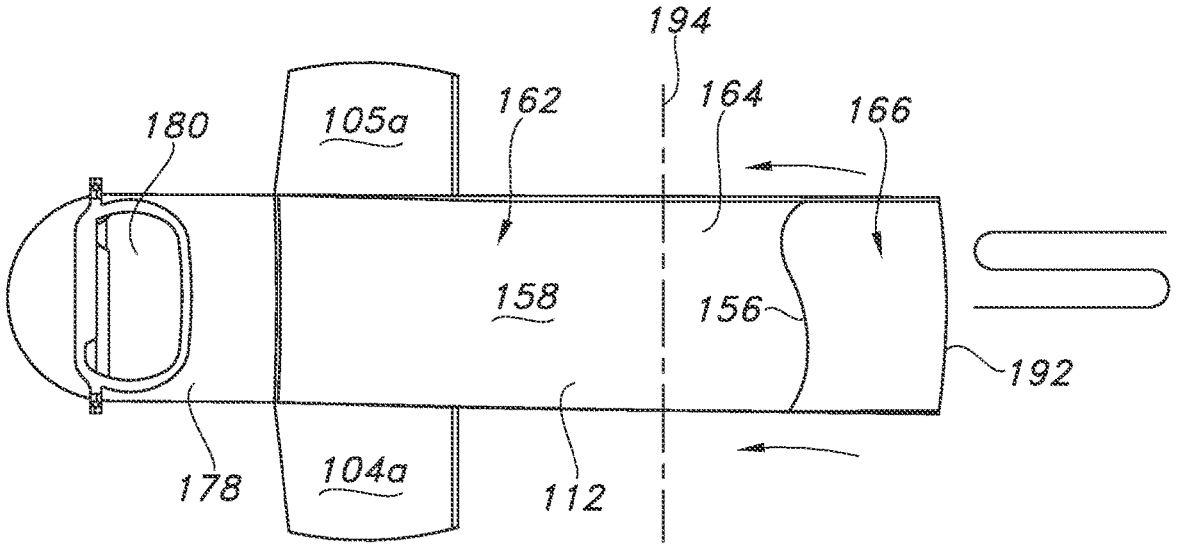
FIG. 8 illustrates the gown of FIG. 1A after performing step 8 of the disclosed method of folding the gown.

Next, in step 8, illustrated in FIG. 8, the lower section 166 of the gown 101 is folded upward in a CS' shape to fold the gown 101 in half along fold line 194.

Figure 9:
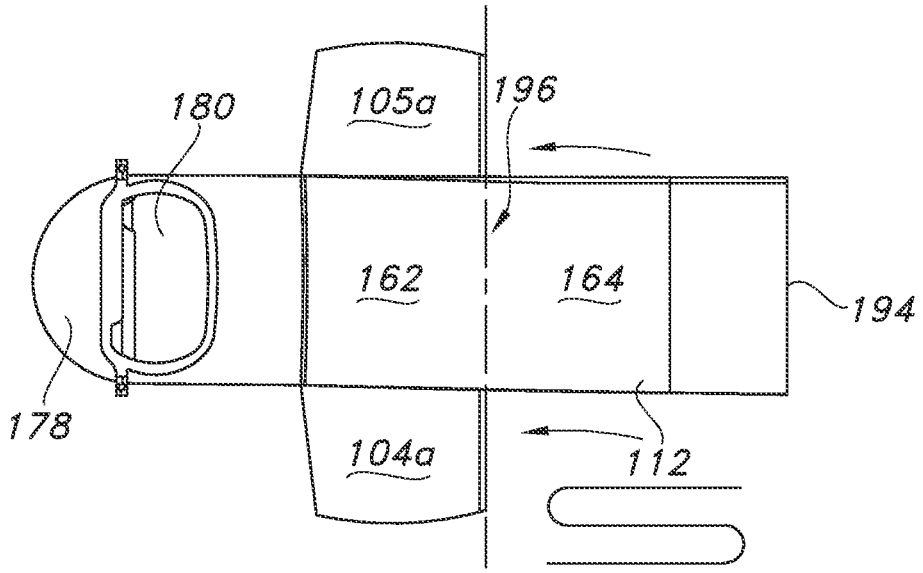
FIG. 9 illustrates the gown of FIG. 1A after performing step and during performance of step 9 of the disclosed method of folding the gown.

Then, in step 9, as shown in FIG. 9, the middle section 164 of the gown 101 is folded upward in an CS' shape to fold the gown 101 in half again along the fold line 196. In the folded configuration shown in FIG. 9, the gown 101 is folded into a rectangular shape having the upper portion 104*a* of the sleeve 104 extending from a first side, the upper portion 105*a* of the sleeve 105 extending from a second side opposite the first side, and the hood 178 and visor 180 extending from the proximal end 154, such that the folded gown 101 has a width W approximately equal to a width of each of the sleeves 104, 105 (as shown in FIG. 9).

Figure 10:
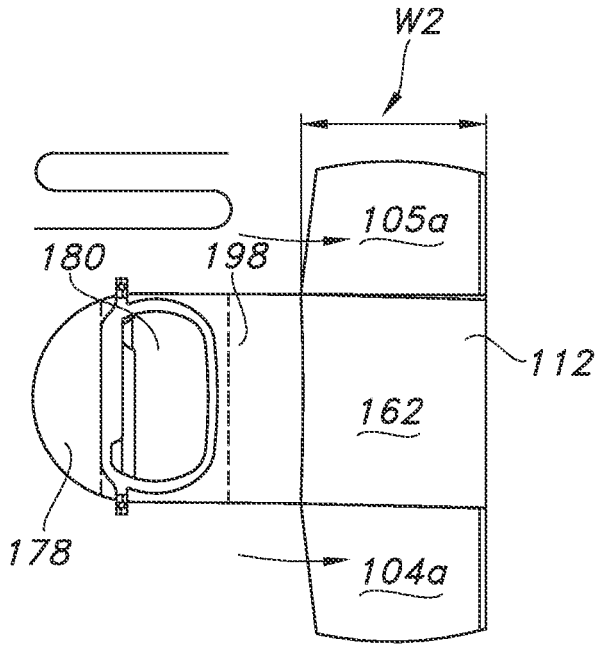
FIG. 10 illustrates the gown of FIG. 1A after performing step 9 and during performance of step 10 of the disclosed method of folding the gown.

Next, in step 10, as shown in FIG. 10, the hood 178 is folded in an CS' shape such that the visor 180 is exposed on top. The folded hood 178 and visor 180 is folded such that the hood 178 rests on, e.g., directly on top of, the upper portion 162 of the folded gown 101, as shown in FIG. 11.

Finally, in step 11, as shown in FIG. 11, the upper portion 104*a* of the first sleeve 104 is folded toward the midline along an upper sleeve fold line 199*a* so that the upper portion 104*a* is folded over the visor 180, and the upper portion 105*a* of the second sleeve 105 is folded toward the midline along an upper sleeve fold line 199*b* so that the upper portion 105*a* is folded over the visor 180, to form the completed folded article 100, illustrated in FIG. 12. The upper sleeve fold line 199*a* coincides with a sleeve opening 108 at a point where the sleeve 104 extends from the gown 101, which is where a wearer may insert one of their arms, e.g., their right arm, into the sleeve 104. The upper sleeve fold line 199*b* coincides with a sleeve opening 109 at a point where the sleeve 105 extends from the gown 101, which is where a wearer may insert one of their arms, e.g., their left arm, into the sleeve 105.

The completed folded article 100, as shown in FIG. 12, has approximately the same dimensions, size and shape as the visor 180. The folded article 100 has a width W2 and a length L that are approximately equal to the width and length of the visor 180, respectively. For instance, the width W2 can be in a range from about 8 inches to about 18 inches, such as from about 10 inches to about 15 inches, for example, in one embodiment about 12 inches. The length L can be in a range from about 12 inches to about 24 inches, such as from about 16 inches to about 20 inches, for example, in one embodiment about 18 inches. Moreover, as shown in FIGS. 1A-B, the length L of the folded article 100 and the visor 180 can be about equal to a width W1 of the gown 101 that is generally constant from the proximal end 154 to the distal end 156.

As a result, this folded article 100 presents the sleeve openings 105 of the gown 101 to a wearer to initiate the donning process by inserting their hands into the sleeve openings 105 without contacting the other portions of the gown 101. Then, when the wearer's hands are within the sleeve openings 105, the clips 182 of the visor 180 are accessible to be grasped and allow the wearer to use the inner surface 112 of the sleeve 104 to connect the visor clips 182 to a helmet or other head covering prior to donning the rest of the gown 101. By folding the gown 101 in a compact manner with the distal end 156 folded toward the proximal end 154 as shown in FIGS. 7-11, the folded configuration of the folded article 101 prevents the entire fabric of the gown 101 near the distal end 156 from dropping down and/or touching the floor at the beginning of the donning process. Moreover, the method of folding the gown 101 that results in the folded article 100 also allows for an assisted donning process in which an already sterile individual may assist the wearer with the process of donning the gown 101.

This written description uses examples to disclose the invention, including the best mode, and also to enable any person skilled in the art to practice the invention, including making and using any devices or systems and performing any incorporated methods.

The invention claimed is:

1. A folded article comprising:

a garment comprising a body and two sleeves, wherein the garment includes an inner surface and an outer surface, wherein each sleeve is connected to the body at a sleeve opening on the inner surface of the garment, the garment further comprising a hood, the hood including a visor having a length and a width;

wherein the garment is folded in a configuration such that the sleeve openings are exposed for ease of donning the garment and none of the outer surface of the garment is exposed; and wherein the folded article comprises a shape and size that matches the length and width of the visor.

2. The folded article of claim 1, wherein each of the sleeve openings extends parallel to an axis extending along the width of the visor.

3. The folded article of claim 1, wherein each sleeve comprises an upper sleeve portion and a lower sleeve portion, wherein the upper sleeve portion of each sleeve is folded over the visor.

4. The folded article of claim 3, wherein the lower sleeve portion of each sleeve is folded within the upper sleeve portion of each respective sleeve.

5. A method of folding a garment comprising the steps of:

providing a garment comprising a body, a first sleeve and a second sleeve, wherein the garment includes an inner surface and an outer surface, wherein the first sleeve is connected to the body at a first sleeve opening on the inner surface of the garment and the second sleeve is connected to the body at a second sleeve opening on the inner surface of the garment;

turning the garment inside-out such that the inner surface of the garment is exposed;

tucking a lower portion of the first sleeve within an upper portion of the first sleeve and tucking a lower portion of the second sleeve within an upper portion of the second sleeve such that the lower portion of the first sleeve and the lower portion of the second sleeve are each in contact with the outer surface of the garment;

folding a distal end of the body of the garment along a first body fold line toward a proximal end of the body of the garment;

folding the body of the garment one or more times to form at least one S-shaped fold; and folding the upper portion of the first sleeve over the body of the garment along a first upper sleeve fold line to expose the first sleeve opening and folding the upper portion of the second sleeve over the body of the garment along a second upper sleeve fold line to expose the second sleeve opening.

6. The method of claim 5, wherein the garment further comprises a hood having a visor, the hood extending from the proximal end of the body of the garment, further wherein the method comprises a step of folding the hood along a hood fold line such that the hood and visor are positioned on top of the body of the garment.

7. The method of claim 6, wherein the garment is folded such that the visor is exposed atop the body of the garment.

8. The method of claim 7, wherein the upper portion of the first sleeve is folded along the first upper sleeve fold line such that the upper portion of the first sleeve is positioned on top of the visor.

9. The method of claim 6, wherein the upper portion of the first sleeve is folded along the first upper sleeve fold line such that the upper portion of the first sleeve is positioned on top of the visor.

10. The method of claim 5, wherein the first upper sleeve fold line coincides with the first sleeve opening and the second upper sleeve fold line coincides with the second sleeve opening.

11. The method of claim 5, wherein the lower portion of each sleeve comprises a cuff, further comprising a step of folding the cuff of the first sleeve toward the upper portion of the first sleeve along a first lower sleeve fold line and folding the cuff of the second sleeve toward the upper portion of the second sleeve along a second lower sleeve fold line.

12. The method of claim 5, wherein the lower portion of the first sleeve and the lower portion of the second sleeve overlap each other.

13. The method of claim 5, wherein the body of the garment comprises a front panel and first and second rear panels, wherein the first and second rear panels are separated when the step of tucking the lower portions of each sleeve is performed.

14. A method of preparing a protective garment for donning, the method comprising steps of:

providing a garment having a body, a first sleeve and a second sleeve, a hood and a visor, wherein the garment includes an inner surface and an outer surface, wherein the first sleeve is connected to the body at a first sleeve opening on the inner surface of the garment and the second sleeve is connected to the body at a second sleeve opening on the inner surface of the garment; and folding the garment such that the garment is configured to be grasped by a wearer by the inner surface of the garment without touching the outer surface of the garment, wherein the garment is folded such that the wearer is configured to insert their arms into the first sleeve opening and the second sleeve opening of the inner surface of the garment prior to accessing the body of the garment, and wherein the garment is folded such that that the visor is accessible to the wearer without touching the outer surface of the garment after the wearer inserts their hands into the sleeve openings.

15. The method of claim 14, wherein the step of folding the garment includes tucking a lower portion of each sleeve within an upper portion of each sleeve such that the lower portion of the first sleeve and the lower portion of the second sleeve is in contact with the outer surface of the garment.

16. The method of claim 15, further wherein the lower portion of the first sleeve and the lower portion of the second sleeve overlap each other.

17. The method of claim 14, wherein the hood comprises clips configured to attach the visor to a piece of headwear, wherein the step of folding the garment comprises folding the garment such that the clips are accessible to the wearer without touching the outer surface of the garment after the wearer inserts their hands into the sleeve openings.

18. The method of claim 14, wherein an upper portion of the first sleeve is folded along a first upper sleeve fold line and an upper portion of the second sleeve is folded along a second upper sleeve fold line such that the upper portion of the first sleeve and the upper portion of the second sleeve are positioned on top of the visor.

19. The method of claim 18, wherein the first upper sleeve fold line coincides with the first sleeve opening and the second upper sleeve fold line coincides with the second sleeve opening.

* * * * *